US005516971A

United States Patent [19]

Hurley

[11] Patent Number: 5,516,971

[45] Date of Patent: May 14, 1996

+

[54] PROCESS FOR DISPOSAL OF WASTE PROPELLANTS AND EXPLOSIVES

[75] Inventor: Eldon K. Hurley, Draper, Va.

[73] Assignee: Hercules Incorporated, Wilmington, Del.

[21] Appl. No.: 238,292

[22] Filed: May 5, 1994

[51] Int. Cl.[6] ..... C06B 21/00

[52] U.S. Cl. ..... 588/203; 588/202; 149/124

[58] Field of Search ..... 588/202, 203; 149/124

[56] References Cited

U.S. PATENT DOCUMENTS

| | | | |
|---|---|---|---|
| 2,362,066 | 11/1944 | Hales et al. | 588/218 |
| 3,778,320 | 12/1973 | Yosim et al. | 149/109.2 |
| 3,848,548 | 11/1974 | Bolejack, Jr. et al. | 588/203 |
| 4,198,209 | 4/1980 | Shaw et al. | 23/302 R |
| 4,661,179 | 4/1987 | Hunter et al. | 149/124 |
| 5,250,161 | 10/1993 | Chin et al. | 204/131 |

*Primary Examiner*—Ngoclan Mai
*Attorney, Agent, or Firm*—Mark Goldberg

[57] ABSTRACT

An improved non-pyrolytic disposal process for nitrocellulose-based explosives and rocket propellants is disclosed. Explosive and propellant particles are digested by contact of the particles with an aqueous solution containing from about 5 to 20% by weight caustic (NaOH) maintained at a temperature of about 50° C. to 100° C. and under conditions of agitation until digestion is essentially complete. The resulting by product contains a mixture of depleted caustic and a water soluble sludge which can be disposed of or further processed. The process minimizes environmental concerns brought about by the open burning of high energy materials.

15 Claims, 1 Drawing Sheet

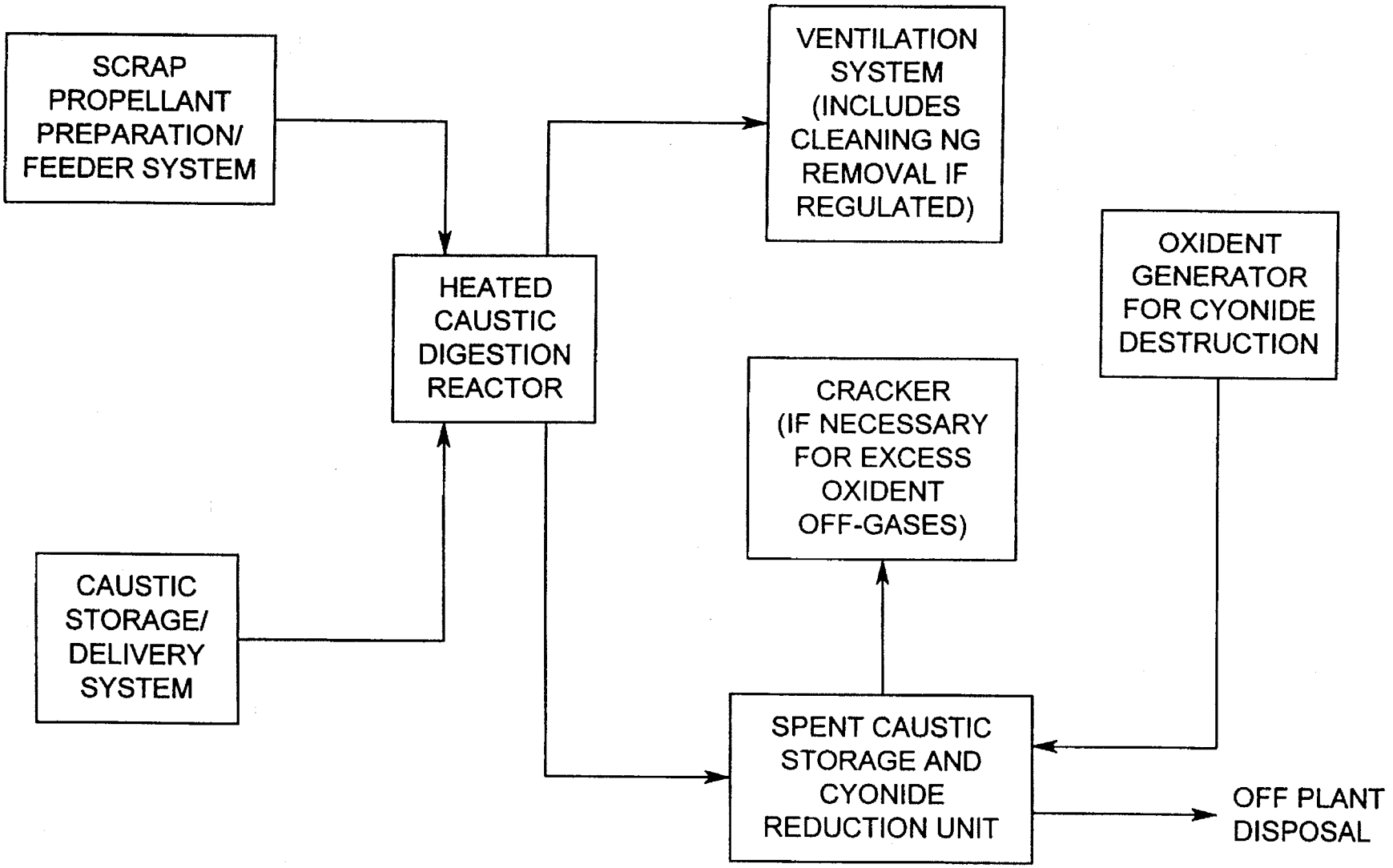
SCRAP PROPELLANT PREPARATION/ FEEDER SYSTEM
HEATED CAUSTIC DIGESTION REACTOR
CAUSTIC STORAGE/ DELIVERY SYSTEM
VENTILATION SYSTEM (INCLUDES CLEANING NG REMOVAL IF REGULATED)
CRACKER (IF NECESSARY FOR EXCESS OXIDENT OFF-GASES)
OXIDENT GENERATOR FOR CYONIDE DESTRUCTION
SPENT CAUSTIC STORAGE AND CYONIDE REDUCTION UNIT
OFF PLANT DISPOSAL

PROCESS FOR DISPOSAL OF WASTE PROPELLANTS AND EXPLOSIVES

The present invention relates to an environmentally safer process for the destruction of nitrocellulose-containing waste propellants and explosives by caustic digestion.

Nitrocellulose-based explosives generally contain a mixture of nitrocellulose, a high energy plasticizer such as nitroglycerin or other nitrated polyols, an oxidizer such as ammonium perchlorate, and a stabilizer material such as nitro-diphenylamine. Nitrocellulose propellants are of similar composition and double base propellants also include salts of various metals such as lead and/or copper salts to modify the ballistic properties of the propellant.

During the production of propellants and explosives, a certain amount of waste is inherent with the manufacturing process. In particular, quantities of wastes are generated from machining operations and contaminated process equipment. Considerable quantities of waste may also be generated from the demilitarization of obsolete ammunition.

The established processes for the disposal of waste propellants and explosives are open burning, open detonation, and incineration. Scrap which is not contaminated with foreign materials (metal, wood, gravel, dirt) can be disposed of in an explosive waste incinerator; however, contaminated scrap must be disposed of via open burning. Permits for open burning are no longer readily available. Incineration of leaded propellants pose additional permitting difficulties due to lead classification as a hazardous waste and the potential of lead escaping with the flue gas during incineration. Therefore, development of an alternate disposal process is advantageous.

Disposal processes which do not involve open burning are disclosed in the prior art. For example, U.S. Pat. No. 3,848,548 discloses a process for the incineration of waste propellants and explosives wherein particulate propellants are mixed with water, ground to a particle size of less than 0.25 inch, and the aqueous suspension introduced with air for pyrolysis in a rotary incinerator maintained at a temperature of 1200° F. to 2200° F. Off gases are contacted with water to remove particulate matter and noxious gases prior to exhausting the gases to the atmosphere.

U.S. Pat. No. 3,778,320 discloses a process wherein particulate scrap propellant or explosive is introduced into a melt of a salt of an alkali metal carbonate and/or hydroxide maintained at a temperature between 150° C. and 1000° C. The scrap is pyrolytically decomposed (burned) within the melt and the gaseous effluent is discharged into the atmosphere either before or after contact with an oxidizing gas.

While these and related processes are generally effective, there still exists a need to develop a process which does not involve incineration of the scrap due to increasingly stringent environmental concerns, which involves less risk of accidental explosion and which can be conducted more efficiently and at less cost.

SUMMARY OF THE INVENTION

The present invention provides a process for the chemical, non-pyrolytic disposal of nitrocellulose-based explosive and propellant solids, comprising contacting said solids in particulate form in a digestion reactor with an aqueous caustic hydrolysis solution having a concentration of caustic in the range of from about 5 to about 20% by weight under conditions of agitation and at solution temperatures in the range of from about 50° C. to about 100° C. until said nitrocellulose is substantially solubilized, and removing an effluent containing digested nitrocellulose solution and dispersed non-solubles from the reactor. The process also includes embodiments wherein vapors emanating from said reactor are condensed and returned to the reactor or scrubbed with a caustic solution to decompose any nitrates contained therein. The effluent removed from the reactor may be further treated with an oxidizing gas to oxidize the cyanide content of the effluent prior to disposal. The propellants and explosives which can be treated by the process of the present invention include those that contain a high energy plasticizer.

The process can be utilized for disposal of scrap explosives, scrap propellants, waste propellant from obsolete weapon systems and old propellants in which stabilizers have been consumed (necessitating disposal for safety considerations).

BRIEF DESCRIPTION OF THE DRAWING

FIG. 1 is a schematic flow diagram of the various steps in a preferred process.

DETAILED DESCRIPTION OF THE INVENTION

The caustic digestion process of this invention is basically a hydrolysis process wherein cellulose nitrate molecules are solubilized and at least some nitrate groups present in the nitrocellulose and energetic plasticizer are converted to less energetic forms such as nitrites, nitrogen gas, and cyanide. The process utilizes commercially available items such as depicted in FIG. 1.

These items are: a heated reactor for digestion of the scrap, a storage/delivery system for the caustic; a scrap propellant preparation/feeder system; a ventilation/scrubber system for removal/cleanup of the air, an oxidant generation/delivery system; ozone cracker (if ozone utilized as the oxidizer); a waste caustic collection/storage/cyanide destruction system for storage of the resultant waste and destruction of cyanide prior to shipment to an off-plant treatment/disposal facility.

A first step in the process involves grinding the propellant or explosive solids to a particle size which maximizes surface area for contact with the caustic. This facilitates caustic digestion in as short a period of time as possible. Generally speaking, the solids should be ground to a size of less than about 3/16 in US Mesh. For safety reasons, the propellant should be wet ground or shredded in the presence of water using suitable equipment such as described in U.S. Pat. No. 3,848,548. The aqueous slurry containing ground solids is then transferred to a suitable screening or centrifuge device and de-watered.

Grinding of the solids is not necessary, however, since the process is equally applicable to digestion of larger size scrap particles having dimensions of up to about 3 inches. However, digestion of larger particles takes place more slowly because of decreased surface areas.

The solid particles are next fed into a suitable reactor containing fresh, heated aqueous caustic solution for the digestion (hydrolysis) process, which commences on contact of the particles with the caustic solution. The feed may be continuous or intermittent, and the total amount of solids fed into the reactor per digestion cycle should be in the range such that the weight ratio of caustic (solids basis) to explosive or propellant solids ranges from about 0.4 to 1.0 to about 1.0 to 1.0 respectively, more preferably from about 0.50 to about 0.85 to 1.0 respectively. Operation within these ratios provides the optimum stoichiometric ratio for complete digestion of the propellant or explosive per digestion cycle.

The caustic material employed in the process is a strong alkali base such as sodium hydroxide, potassium hydroxide or mixtures thereof. Sodium hydroxide is the preferred caustic material as it affords more complete and efficient digestion at an optimum ratio of about 0.80 parts by weight of sodium hydroxide per 1 part by weight of explosive or propellant solids.

The maximum concentration of fresh caustic in the aqueous solution is important in order to maximize the generation of water soluble digestion products. At above 20% by weight concentration, the propellant or explosive particles are difficult to wet which impedes digestion. Also, an undesirable, nondigestible by-product or scum not soluble in water is formed in the reaction mass as digestion proceeds. Accordingly, the preferred concentration of fresh caustic in water lies in the range of from about 5 to 20% by weight, more preferably from about 10 to 20% by weight, and most preferably from about 15 to 20% by weight. The pH of the caustic solution generally will range from about 12.5 to about 13.5.

Another factor which influences the rate of digestion is the temperature of the caustic solution, i.e., the higher the temperature the more rapid the digestion. Preferably the reaction is conducted at solution temperatures of from about 50° C. to about 100° C., more preferably from about 90° C. to about 100° C.

The reactor in which digestion takes place may comprise any suitable horizontal or vertical tank reactor equipped with means for continuously agitating the reaction mass. Agitation means includes a mechanical agitator and may also include an air or steam sparger or a combination of two or more of these means.

If injection of live steam is not used for heating, a mechanical agitator can be used to provide circulation and turbulent mixing. Mixing provides the following advantages. First, agitation of the solution accelerates the digestion rate by not allowing a layer of weak or used caustic to form around the propellant. Second, agitation reduces the possibility for hot spots and boiling reactions in the digestion vessel by keeping the liquid well mixed and of a uniform temperature. Third, circulation will increase the heat transfer rate between the liquid and the water cooled heat transfer surface, so that the reaction temperature may be controlled more accurately and more responsively. Finally, good turbulent mixing will keep the digestion sludge in suspension so that it may be pumped out of the digestion vessel with the liquid.

The reactor is also preferably equipped with heating and cooling means to achieve and maintain reaction temperatures of up to 100° C. Such means include steam or hot air sparging (which also provides mixing) or the provision of a steam or hot water jacketed reactor, which can provide either heating or cooling of the reactor contents.

The process is preferably conducted at or moderately above atmospheric pressure and accordingly the reactor is equipped with a venting means or pressure release valve to allow hot vapors to exhaust. Preferably exhausted vapors, i.e. water and volatile organic compounds, are passed through condenser coils and returned to the reactor to minimize water loss and return any volatile hazardous compounds present in the condensate back to the reactor for hydrolytic destruction. Alternatively, these vapors may be scrubbed separately by passage through a caustic scrubber to further decompose any nitrates and other hydrolysable organics present in the vapor, followed by atmospheric venting.

It is important that a certain level of reactor head space be permitted above the reaction mass. Headspace is required because the digestion reaction forms a foamy scum and because the heat generated can cause the solution to boil and the foam/scum to rise. Preferably the level of liquid present in the reactor during reaction should be maintained below 60% of the volume of the reactor, more preferably in the range of from about 40 to 50% of the volume of the reactor.

The concentration of fresh caustic at the beginning of the process is preferably in the range of 10 to 20% by weight, more preferably 15 to 20% by weight. Two mechanisms are operative to change the concentration as the reaction proceeds. First, digestion of the solids consumes the caustic thereby reducing the concentration. This is the predominant mechanism during the early part of each digestion cycle during which time the reaction proceeds rapidly. The second mechanism is evaporation of water from the hot caustic solution which increases caustic concentration. This is the predominant mechanism during the latter part of the reaction as the rate of digestion slows. Thus it may be necessary to introduce additional water into the system during the process to account for lost water through evaporation and maintain the concentration of caustic below about 20% by weight and maintain reactor liquid volume at least 40%. Digestion is substantially complete when the concentration of caustic drops below about 2% by weight at a 40–50% liquid reactor volume. The time for complete digestion depends on solids particle size, degree of mixing, reaction temperature and other factors, and generally ranges from about 15 minutes to about two hours after all of the propellant or explosive scrap particles have been introduced into the reactor.

The digested by-product of the process is basically a liquid composed primarily of spent caustic liquid having dissolved therein a water soluble sludge material. This by-product will also contain less than about 0.5% by weight of cyanide compounds and/or hydrogen cyanide, and the various metals which may have been ingredients in the propellant, including lead. Thus the process provides a much more environmentally friendly technique for lead disposal in contrast to open air burning.

Laboratory experimentation determined that the by-products from the digestion of a leaded propellant formulation utilizing a 100 pound basis are typically: (1) 20 pounds of a water soluble sludge consisting of (wt %): 0.52% lead, 0.15% copper, 26.2% sodium, 4.07% nitrates, 4.26% nitrites, 3.77% sulfates, and 61.03% organics and other components: (2) 350 pounds of spent caustic liquid with a specific gravity of 1.28, 4,705 mg/L lead, 1,495 mg/L copper, 220,000 mg/L organics, and 896 mg/L cyanide, pH>12.5; and (3) 130 pounds of vapor consisting chiefly of water, some carbon dioxide, and whose condensate has a pH of 9 and contains dissolved nitroglycerin.

After completion of the digestion, the by-product effluent is pumped out of the reactor into a tank for disposal or for further treatment to lower the cyanide content of the effluent. This may be accomplished by bubbling an oxidizing gas, such as air, oxygen or ozone, through a heated agitated mass of the effluent in a tank mixing device similar in configuration to the digestion reactor.

In a preferred process of the invention, 1000 pounds of ground propellant are gradually introduced into a 1000 gallon mixing tank containing 800 pounds of caustic dissolved in 3,490 pounds of water (18.65% solution) maintained at a temperature of about 95° C. This provides for about a 1.25:1 headspace to liquid ratio. Mixing is continued for a period of one hour after all the propellant has been fed to the reactor. Reaction temperature is maintained at about 90° C. to 100° C. during the course of the digestion and reaction vapors are condensed and returned to the reactor to control exothermic temperature rises and maintain liquid volume. After completion of the digestion, the digestion product is pumped from the reactor and into a holding tank for further processing.

What is claimed is:

1. A process for the chemical disposal of nitrocellulose-based explosive and propellant solids comprising contacting particles of said solids in a digestion reactor with an aqueous caustic hydrolysis solution having a concentration of caustic in the range of from about 5 to about 20% by weight under conditions of agitation and at solution temperatures in the range of from about 50° C. to about 100° C. until said nitrocellulose is substantially solubilized, and removing an effluent containing digested nitrocellulose solution and dispersed non-solubles from said reactor.

2. The process of claim 1 wherein said caustic is sodium hydroxide.

3. The process of claim 2 wherein the temperature of said hydrolysis solution is maintained at from about 90° C. to about 100° C.

4. The process of claim 2 wherein the initial concentration of said sodium hydroxide in aqueous solution ranges from about 15 to about 20% by weight.

5. The process of claim 1 wherein the particle size of said solid particles fed to said reactor is less than about 3/16 US Mesh.

6. The process of claim 1 wherein the level of liquid in said reactor occupies less than about 60% of the volume of said reactor.

7. The process of claim 6 wherein the level of liquid present in said reactor ranges from about 40 to 50% of the volume of said reactor.

8. The process of claim 1 wherein vapors emanating from said reactor are condensed and returned to said reactor.

9. The process of claim 1 wherein said effluent removed from said reactor is subjected to oxidation conditions to oxidize cyanide components present in said effluent.

10. The process of claim 1 wherein vapors emanating from said reactor are passed through a caustic scrubber to decompose any nitrates present in said vapor.

11. The process of claim 2 wherein the weight ratio of sodium hydroxide to explosive or propellant solids contacted in said reactor ranges from about 0.40 to 1 to about 1.0 to 1 respectively.

12. The process of claim 11 wherein said weight ratio ranges from about 0.50 to 1 to about 0.85 to 1 respectively.

13. The process of claim 1 wherein said solids comprise a propellant containing at least one metal salt as a ballistic modifier.

14. The process of claim 13 wherein said metal salt comprises a lead salt.

15. The process of claim 1 wherein said nitrocellulose-based explosive and propellant solids contain a high energy plasticizer.

* * * * *